United States Patent [19]

Ogle

[11] 3,973,776

[45] Aug. 10, 1976

[54] ARROW QUIVER AND PACK FRAME

[76] Inventor: Terry Richard Ogle, 9504 Candywood Lane, Louisville, Ky. 40291

[22] Filed: June 19, 1974

[21] Appl. No.: 480,966

[52] U.S. Cl. ..... 224/1 B; 224/25 A

[51] Int. Cl.[2] ..... A45F 3/10; A45F 4/00

[58] Field of Search ..... 224/1 B, 1 R, 25 A, 224/8 R, 8 A, 9, 10, 25 R, 5 R; 135/1 R, 5 R, 5 C

[56] References Cited

UNITED STATES PATENTS

| | | | |
|---|---|---|---|
| 2,881,817 | 4/1959 | Brion | 224/1 B |
| 2,897,864 | 8/1959 | Schmidt | 224/1 B |
| 2,922,465 | 1/1960 | Johansson et al. | 224/9 |
| D228,043 | 7/1973 | Sloop | 224/9 X |

*Primary Examiner*—Robert J. Spar
*Assistant Examiner*—Jerold M. Forsberg

[57] ABSTRACT

An elongated, upright frame support assembly has been designed to internally and individually support a plurality of upstanding arrows which opens to upward access and receives downwardly each arrow passing into countersunk telescoping tubes which encase each arrow of various lengths. This support assembly further includes a frame which protects arrows and provides attachment points for a camp pack and is covered by a camouflage cloth covering with various size pockets to carry hunting equipment. When this assembly is removed from the hunter, it may be opened in step ladder fashion and support a person standing on top, sitting or hide behind. This assembly is supported by a shoulder harness and is adapted to support the upstanding assemblage on the carrier's back in an upright manner so that the extreme longitudinal base descends to the waist and the longitudinal top extends just above the head region.

4 Claims, 8 Drawing Figures

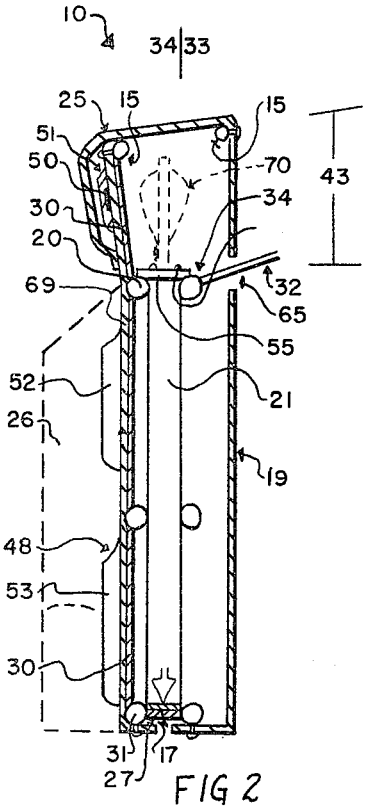
FIG 2
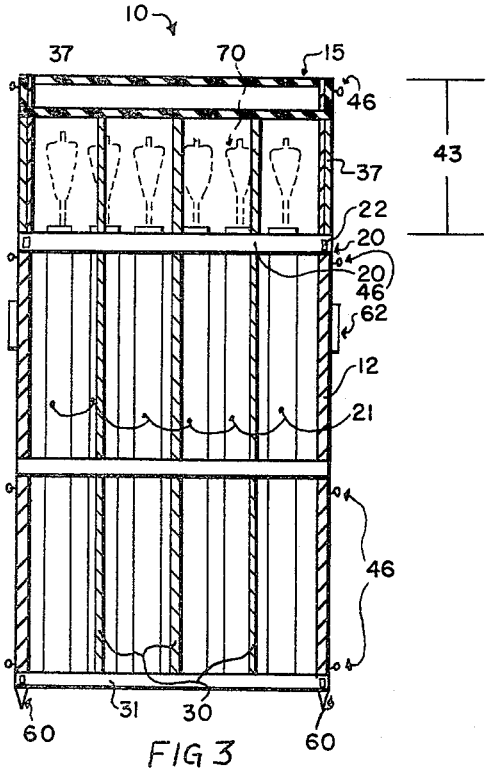
FIG 3
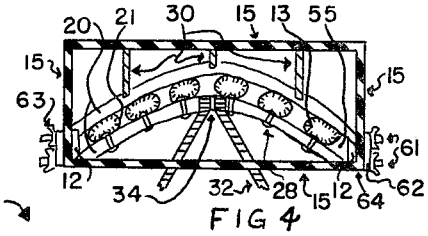
FIG 4
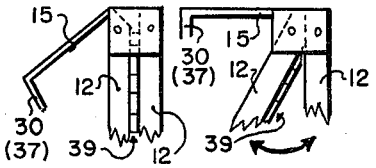
FIG 7
FIG 1
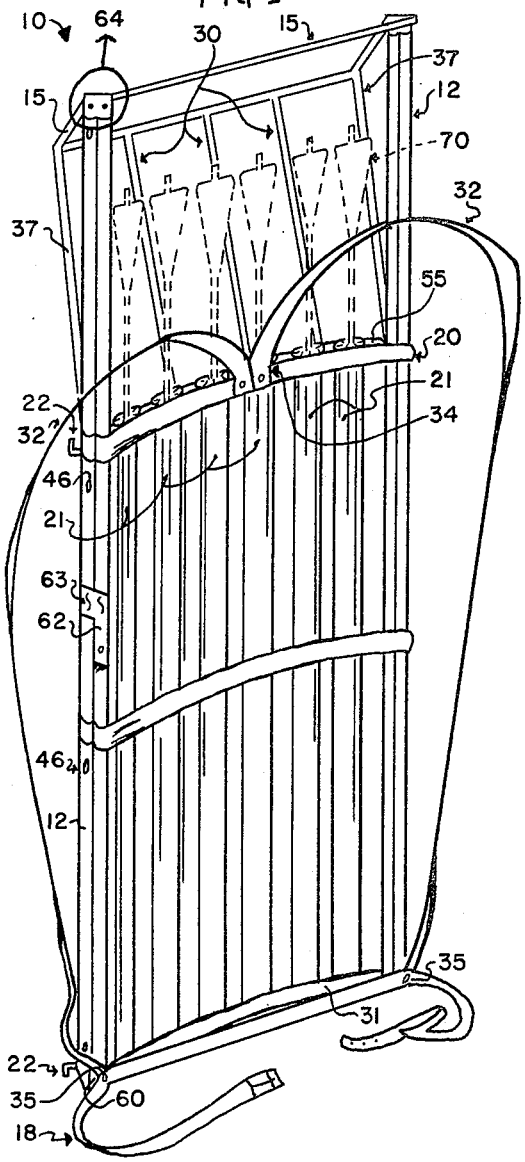

ARROW QUIVER AND PACK FRAME

The old style of hunting is still very popular among American bowhunters. This old method as in the years past, finds the deer bowhunter hiking through the woods with his camping supplies and archery tackle strapped on his back. He locates a campsite, pitches his tent and surveys the area for suitable terrain, cover and deer sign. After continuous searching the hunter locates the most advantageous spot to encounter his quarry, removes his quiver, opens it in step ladder fashion and sets up a blind. Kneeling behind, sitting on or standing upon the quiver, the hunter will camouflage himself during sunrise and sunset hours keeping a readied arrow for approaching deer. During the daylight interim, the hunter will close the quiver, strap it to his back and move about the fields or woods in search of moving deer. Food and drink are essential cargo to fortify the deer hunter during this phase of the hunt.

This very invention has been conceived through actual hunting experiences by an ardent bowhunter and is designed to fill specific needs which present marketable items cannot wholly satisfy. This original back quiver of light weight construction is capable of carrying a complete array of arrows, archery tackle, food and duffle required on an extended hunting trip. It also facilitates carrying sandwiches and drink during the hunt. This original back quiver is mounted to the hunter's back using a two-strap shoulder harness, and is easy to put on or take off when arriving or departing the blind or campsite.

If the hunter is successful, a deer of medium weight can be strapped to the quiver and carried out on the back of the hunter. The quiver will not interfere with the hunter's transition through swamp, heavy brush, or cornfields as is common with other popular quivers. This invention utilizes a camouflage covering and camp pack to blend with the natural background. The arrows do not clatter or bang together during the carry, insuring that the breadheads remain sharp, arrows straight, and deer are not spooked.

Finally, this invention is a sturdy, lightweight, waterproof, shockproof container in which to store arrows and archery tackle at home; pack arrows and equipment during travel, and carry arrows, archery tackle, food and camping duffle into the woods and to the campsite. Such an invention can only alicit gratitude and appreciation from fellow bowhunters. Because this invention incorporates the best qualities of a packframe and an arrow quiver into an integral framework enabling the hunter to enrich his outdoor experiences. It soon becomes apparent that this invention supports many desirable features which can aggrandize the capabilities of the bowhunter and outdoorsman in the field.

The main objective of this invention is to provide a support assembly for a plurality of arrows which are internal to the said assembly and which attaches to hunter by shoulder harness.

Another objective of this invention is to provide a suitable sturdy lightweight, shockproof, waterproof, protective case in which a good supply of arrows and archery tackle can be stored, transported and carried into the field without damaging the arrows.

A third objective of this invention is to provide a suitable sturdy lightweight framework in which a pack assembly can be easily fitted so that a good supply of food and camp equipment can be conveniently transported.

A further objective of this invention is to provide a support assembly which can be extended in step ladder fashion to form an "A" frame onto which a person may stand, sit or hide behind when removed from the hunter's back.

A further objective is to design an assemblage capable of accepting arrows of different lengths in a downward motion through the uppermost top section.

Another objective of this invention is to provide an article that is totally camouflage in which the periphery is completely covered by a camouflage cloth cover which supports a number of cloth pockets.

A further objective of this invention is to provide a support assembly in which small and medium size game can be secured to and transported out of the field.

The final object of this invention that is specifically stated is to provide an article which is simple to construct and conforms to conventional forms of manufacture that would be economically feasible to produce and relatively trouble free in operation.

These and other objects and advantages implied become more apparent when analyzing construction and detailed operation which is explained in greater depth as further described and claimed. This invention as disclosed in the following specifications include any or all modifications or variations as may come within the spirit and scope of the said invention.

The numbered illustrations and accompanying drawings are submitted in part for amplifying the description and for identifying the embodiment. These numbers correspond with the numerals on the references.

FIG. 1 is an enlarged front perspective view showing the framework of this very invention without the cloth covering.

FIG. 2 is a fragmentary vertical sectional view defined by a plane passing through the longitudinal center line of the assemblage illustrated in FIG. 1.

FIG. 3 is a front view showing the most rearward plane of construction showing layout of front section.

FIG. 4 is a horizontal top sectional view showing the relationship of construction.

FIG. 7 is a close up view of construction at superior end of main support tube.

Figure 5:
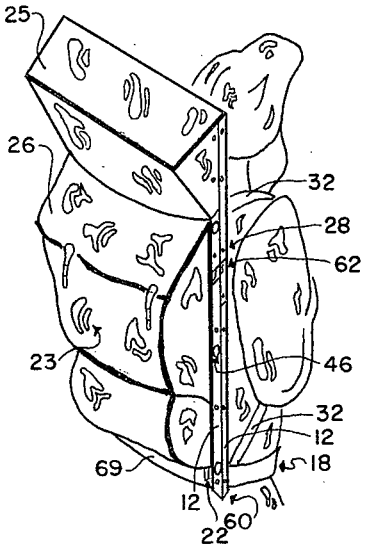
FIG. 5 is a perspective view of a bowhunter with the quiver mounted on his back.
Figure 8:
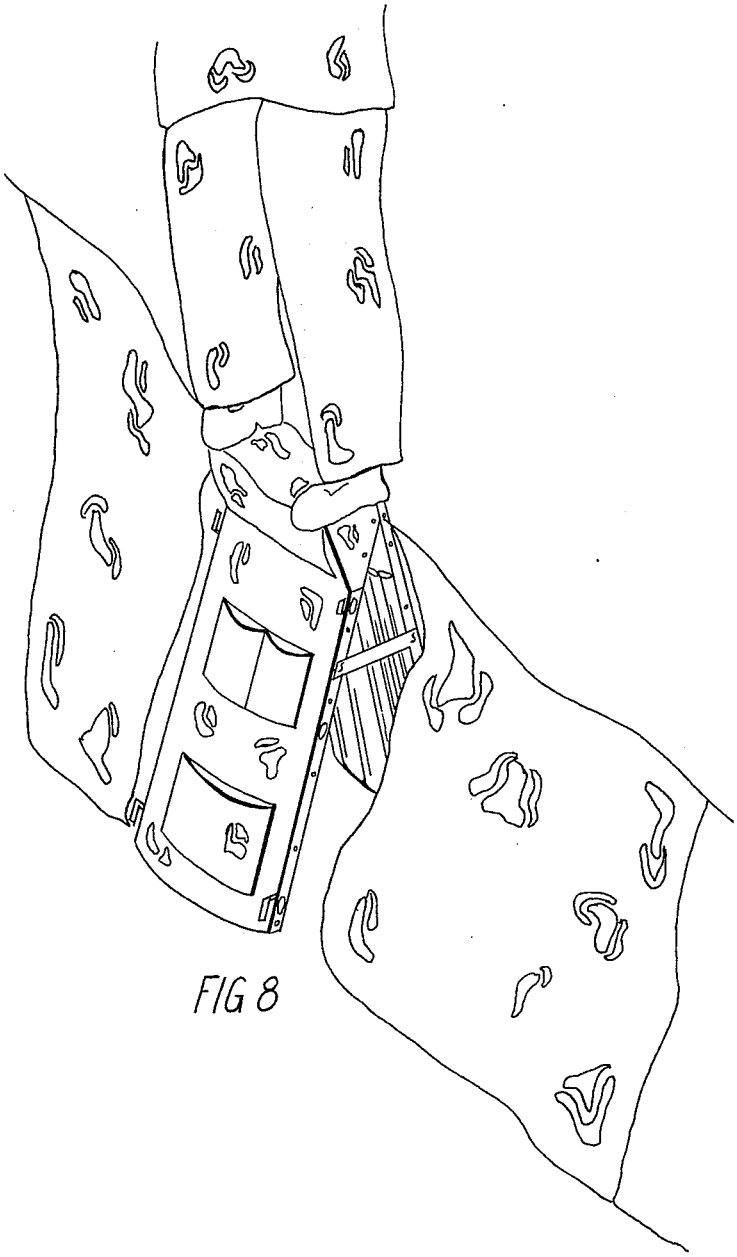
FIG. 8 is a perspective view of the extended quiver showing the capability of a support stand for the hunter.

To consider more specifically the drawings of the back quiver, refer to numeral 10 as the general designation of this invention. The assembly 10 includes two pair of front and rear facing upstanding parallel main support tubes 12 of light weight durable material in which the opposing main support tubes 12 are separated longitudinally by rubber gasket 39 and in which base of said support tubes 12 are tapered to a dull point 60 as illustrated in FIG. (1). On said support tubes 12 a number of semi-circular crossbrace pairs (of which superior crossbrace 20 is one) is transversely attached to main support tubes 12, in step ladder fashion to front 33 and rear 34 frame sections in line and subsequent to the superior rectangle 15 which is attached to the uppermost portion of the main support tubes 12 angling rearward to be paralled with base when quiver is in the extended position and extending rearwardly a greater distance than the crossbraces, FIG. 2. The main support tube pairs 12 are attached permanently together at the uppermost support joint 64 where a hooded cover is pinned to each main support tube 12 to permit easy rotation of front frame section 33 about the rear frame section 34. The L shaped brace 62 is the temporary brace which can be rotated to select the closed or extended position of this invention. The L shaped brace 62, one on each side, has holes drilled at the three corners of which two holes fit over the threaded studs 61 at any one time located at midpoint on the outboard side on the supports tubes 12 and fastened down by wing nuts 63. The quiver is locked in the closed position during the carry by aligning the holes of the L shaped brace of lesser distance with the midpoint studs on the outboard side of the main support tubes 12, and fasten down by wing nuts 63. When the assembly is removed from the carrier's shoulders and extended in step ladder fashion to form an "A" frame, the L shaped brace 62 is removed and rotated to align the greater distant holes with the two threaded studs and fastened down with wing nuts. The extension mechanism of this assemblage is similar in design and operation to a step ladder.

On the backside of the quiver several small diameter rods 30 are affixed in vertical series perpendicular to and penetrating through each semi-circular rear section running downward to terminate at the base semicircular rear section. The small diameter rods 30 also join the superior rectangle 15 in the same vertical plane. Corner rods 37 of the same diameter are added to connect the rear facing corners of the superior rectangle 15 to the superior cross brace 20 for additional support. This provides a rigid frame rearwardly to support cloth covering and back pack as in FIG. 3. Level with and internal to the first in line superior cross brace 20 is the upper limit of a plurality of equally spaced single line telescoping arrow tubes 21 which pass vertically through the internal portion of each subsequent cross brace and sealed steadfastly in position by rivets 28 FIG. 4 or any conventional means to the rear cross braces and sealing off the base of arrow tubes 27. The upper receptacle of arrow tubes 21 which receive the arrows 70 downwardly is lined with fur type material 13 to hold arrow shaft off rim of arrow tube 21 and prevent arrow clatter and is positioned below the uppermost portion of the quiver to permit the upper interval 43 to house the fletching of various length arrows in a waterproof, shockproof manner. At said receptacle level plane 55 is formed by plastic, epoxy, fiberglass, etc. Attachment points for arrow tubes 21 are located only on front cross braces, even though in closed position the rear cross braces butt up against said arrow tubes 21. Arrow tubes 21 are commonly made of light weight resilient material similar to plastic or any other material which fits into the scope of this invention and provides protection to arrow shaft and arrowhead that does not destroy broadhead integrity when contact is made with the arrow tube 21 walls. The base of each tube is stoppered by a base arrowhead disc 17 which is comprised of an oval upper soft portion of spongelike material to imbed the arrowhead and a lower oval portion of firm composition such as hard rubber to prevent arrow penetration.

The means of saddling the back quiver to the hunter is afforded by an adjustable, flexible two strap shoulder harness 32 whose superior portion jointly attaches at midpoint 34 of the superior semi-circular front cross brace 20 and passing forwardly through hole 65 in cloth cover 19 continuing to inferior portions at lower right and lower left base at 35 on base cross brace 31. Extending horizontal across base of quiver and coincident to the shoulder harness 32 attaching points 35 is waist belt 18 added for additional comfort and back support.

This assemblage 10 supports a camouflage 23 cloth covering of suitably dyed light weight material which blends with natural surroundings. This covering is of two sections; a front portion 19 and a rear portion 69 as in FIG. 6. The front portion is stretched laterally to the extreme outside portion on the main support tube then sewn tightly around the forward portion of the upper rectangle 15 and continues loosely upward beyond frame to form top flap 25 of reinforced waterproof, scuff proof material 24 since the upper rectangle may be stood upon by the hunter. The top flap 25 is attached on the rear portion of quiver to enclose the upper limit of the quiver by any arrangement of hooks or gadets that best fit into the scope of this invention. The upper portion of the rearward cloth covering 69 is drawn tightly around the rearward extention of the superior rectangle 15 and the material descends downwardly to attach at lower of base cross brace 31 and is also pulled laterally to attach by rivets 28 to the extreme sides of main support tubes 12 FIG. 6, in the same manner as front covering 19. This cloth cover arrangement completely encloses rear, front and top spaces of quiver when in closed position and nearly so in open position affording total camouflage cover plus total waterproof and shockproof integrity to all arrows. Such a cover configuration forms a taunt surface on the front portion which contacts the carrier's back and a strong support surface on the rear portion which supports cloth pockets and camp pack.

This quiver utilizes three sets of said pockets. Each set of pockets are lined with a strip of elastic 50 to secure loose objects and each pocket flap 48 seals pocket closed when attached in any conventional manner. Small pockets 51 with many divisions to carry hunting tackle and emergency equipment located above the upper limits of camp pack 26 on the rear cloth cover 69 which is covered by top flap 25 when in closed position. Next in line about midpoint are medium size pockets 52 with two divisions for carrying medium size articles, like ropes, bags, maps and may be used even though camp pack 26 is mounted. Lastly, lower down are lower pockets 53 with one division to transport the biggest items like raincoat, sandwiches, snacks, canteens or thermos with camp pack 26 removed.

Figure 6:
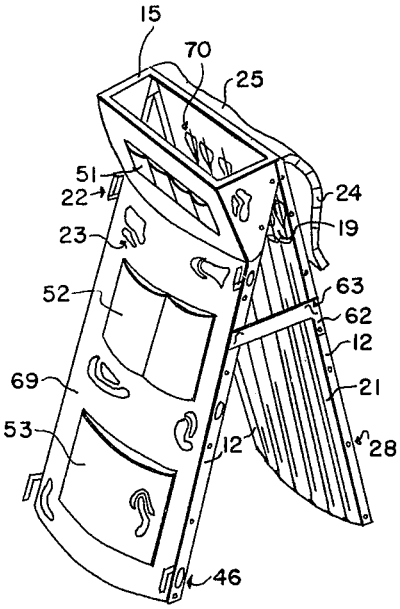
FIG. 6 is a perspective view of a typical blind when the quiver is removed from the hunter's back and extended in "A" frame formation (with the camp pack removed).

After arriving at hunting area, the hunter may prefer to remove quiver and use the stand capabilities here to fore discussed and to stand on the top giving himself a vantage point off the ground, or he may prefer to sit on the quiver or drape his camouflage cloth around it to make a temporary blind and hide behind it as in FIG. 6. In this configuration arrows are quickly and easily dispatched. Specifically located on the main support tubes 12 are four 4 pack hooks 22 capable of supporting each corner of the camp pack 26.

With this described quiver, hunting equipment and archery tackle can easily be organized and stored in the quiver at the hunter's residence. When needed the camp pack 26 can be quickly filled with camping duffle and attached in place on the quiver with pack loops 56 on camping pack 26 fitted over pack hooks 22. Later the pack may be removed and left at the campsite. The lower pockets may then be filled with food and supplies for the hunt. Padeyes 46 are located along main support tube 12 to provide tiedowns as a means to carry an arrow killed deer out of the woods.

From FIG. 5, the drawings show that the flexible shoulder harness 32 supports back quiver slightly below waist with the upper end of assembly 10 disposed of just above the head of the bowman. It can be seen in FIG. 5 that by using one hand to push gently away on the lower base of quiver and the other hand of the bowman can easily reach inside quiver and procure a second arrow in a minimum of time and dispatch the arrow in the conventional manner.

The foregoing realizes only the basic principles of the invention, other skilled in the art may raise other modifications; however, it is not the purpose to limit the invention to exact construction and operation parameters as stated herein but that all such modifications and equivalent forms will fall into the scope of the invention.

What is claimed as new is:

1. What I claim as new, is a support assembly for arrows made up of two similar sections, one behind the other, separated by a rubber gasket, in which each section consists of a pair of upstanding main support tubes pointed at base end and joined equally by a number of horizontal, semicircular crossbraces; the top crossbrace (rectangular in shape) is mounted on the uppermost portion of the main support tubes; the front portion consists of a straight, horizontal crossbrace piece and the rear portion (being squared off instead of semicircular) consists of a U shaped brace extending rearwardly the same distance as the semicircular crossbrace, and angling downward a slight degree to be parallel with the ground when the support assembly is in the open position; lateral padeyes are attached to outboard rear support tubes in order to lash loads to the frame; the two similar sections are joined together at the uppermost limit by a superior hinge, permitting the front section to rotate about the rear section, so that the open position resembles an "A" frame; the spread of the frame is defined by placing the farther distant holes on the "L"-shaped brace over the threaded studs protruding from the outboard midpoint of each main support tube and screwing it down by wingnuts; upon removal of "L"-shaped brace assembly, the quiver can be moved to the closed position and said brace can then be replaced over the same threaded studs, using the smaller distant holes and screwed down by wingnuts, so that the support assembly resembles a packframe in the closed position; a series of vertical support rods descend from the rear portion of the superior rectangle to the lowest in line crossbrace; the two outboard vertical support rods, attached to the outboard corners of the superior rectangle, terminate at the junction of the first in line crossbrace and main support tube; arrows are protected by an outward camouflage cloth covering, on the exterior portion of the front and back sections with each separate piece of cloth being fastened tightly and completely about the full perimeter of the frame, forming a taut surface on the front, which contacts the carrier's back, and a strong support surface on the rear to support the weight of the camp pack; the front section cloth cover continues loosely upward to form a waterproof, reinforced top flap, sealing off the upper portion of the superior rectangle so that when the quiver is in the open or closed position, the arrows are not at all visable; but, when the top flap is open, the arrow will pass unrestricted downward through the superior rectangle into the upper recess of the support assembly and into one of a plurality of upstanding arrow tubes below with furlined receptacle, penetrating between opposing crossbraces; the said arrow is supported in the upright position with the point resting on the arrow tube plug, sealing off the bottom portion of the tube; the upper portion of the plug is a soft material and the lower portion is a hard substance; each arrow tube is attached to the semicircular crossbrace of the front frame section only, and the upper recess freely houses the arrow fletching of various length arrows; a flexible two-strap shoulder harness attaches at midpoint on the uppermost front semicircular crossbrace and passing forward through the front cloth cover hole to attach at the corresponding right and left lower base of the main support tubes; also attached at these points is a waistbelt extending horizontally across the waist of the hunter to help support quiver on his back.

2. In combination with claim 1, the vertical length of said assembly is aligned with the center of the back; the top portion of the quiver ascending somewhat, but not excessively, above the head, and the base descending to the waist.

3. In combination with claim 1, the vertical length of said assembly offers total protection to arrows of different shaft lengths, but not exceeding a predetermined length; each arrow is completely housed within the pack frame configuration.

4. In addition with claim 1 this assembly may support a permanently mounted pack on the rear portion of the cloth cover or an easily removable one, by adding loops to each of the four corners of the pack which will then fit over quiver hooks, welded in position at the point of intersection of the top and bottom in line crossbrace with the main support tubes and is designed for easy removal to expose the medium and large size pockets on the backside of the cloth cover; these pockets are designed to store the bowhunter's supplies in the woods; one set of small pockets utilizing an elastic band inside is also included to hold small items, and is located above the camp pack, accessible under the top flap of the quiver.

* * * * *